United States Patent [19]

Wallace et al.

[11] 4,176,969

[45] Dec. 4, 1979

[54] MIXER AND/OR HEAT EXCHANGER DEVICE

[75] Inventors: Robert A. Wallace, Santa Ana; J. L. McCurdy, Corona Del Mar, both of Calif.

[73] Assignee: Polymer Research, Inc., Big Spring, Tex.

[21] Appl. No.: 916,350

[22] Filed: Jun. 16, 1978

[51] Int. Cl.[2] ..... B01F 7/04; B01F 15/06

[52] U.S. Cl. ..... 366/149; 366/300; 366/301

[58] Field of Search ..... 366/300, 301, 297, 303, 366/149, 91, 97, 149

[56] References Cited

U.S. PATENT DOCUMENTS

| | | | |
|---|---|---|---|
| 635,412 | 10/1899 | Wurster | 366/300 |
| 2,025,077 | 12/1935 | Stewart | 366/300 |
| 2,283,008 | 5/1942 | Bar | 366/301 |
| 4,093,419 | 6/1978 | Tauber | 366/300 |

*Primary Examiner*—Robert W. Jenkins

*Attorney, Agent, or Firm*—Schwartz, Jeffery, Schwaab, Mack, Blumenthal & Koch

[57] ABSTRACT

A mixer and/or heat exchanger for flowable compositions includes dual, parallel, interconnected cylindrical mixing chambers through which intermeshing, counter-rotating bladed mixer elements extend. The mixer blades sweep virtually the entire inner surface area of the chambers and the entire volume within the chambers. The interconnection between the chambers is designed to minimize unswept space within the chambers, and heat exchange medium is circulated around the chambers so the system can be used to heat or cool the composition moving through the mixer.

8 Claims, 5 Drawing Figures

MIXER AND/OR HEAT EXCHANGER DEVICE

FIELD OF THE INVENTION

This invention relates to mechanical mixers for flowable compositions.

BACKGROUND AND PRIOR ART

In chemical processing operations, and in particular extruding of resinous materials, it may be necessary or desirable to blend additives into a viscous composition in a manner that will achieve complete and uniform mixing of the additives and the compositions. This can be a difficult objective to reach in an efficient manner where the additive has considerably less viscosity than the resinous mass, and where the mixing must take place "in-line", that is, while the composition is flowing in a production process.

In the prior art, various in-line blenders and mixers have been proposed, but in practice it has been found that they do not consistently provide a uniform blending of ingredients because of the existence of "dead" spots within the mixers through which portions of the composition can pass without intermixing thoroughly with the main body of the composition flowing through the mixer. In many instances, it is desirable to heat or cool the composition while it is mixed, but prior art apparatus has not always been compatible with good heat exchanger requirements.

SUMMARY OF THE INVENTION

The present invention is an improvement to mixers for flowable compositions. The mixer in accordance with the present invention also can be utilized as a heat exchanger for heating or cooling a composition within the mixer. The invention has as its gist the provision of dual, parallel cylindrical mixing chambers through which extend a plurality of counterrotating mixing blades that sweep the entire internal surface area and volume of the mixing chambers. In addition, a heat exchanger jacket around the mixing chambers permits flow of heat exchange medium in intimate contact with the entire outer wall of the mixing chamber.

The mixing blades are carried by counterrotating blade carriers, one of which is coaxially mounted within each of the chambers. The distance between the longitudinal axes of the cylindrical chambers, which are of equal diameter, is less than twice the radius of each chamber, whereby the circumferences of the chambers intersect. Within the intersecting area, an open channel is provided between the chambers, which is substantially equal in width to the chordal distance between the intersecting points of the circumferences of the chambers.

The mixing blades within the chambers extend virtually adjacent to the inner chamber walls with a minimum of clearance. The blades have a free length extending radially from their respective central carriers, and are mounted on the carriers in a specific manner to enable them to intermesh with each other when the carriers are counterrotated. Specifically, each blade extends radially from its respective carrier and is circumferentially displaced with respect to a next adjacent blade in a progressive helical manner along the length of the carrier. The blades on opposite carriers lie in the same plane opposite each other, but are angularly displaced relative to each other and dimensioned in such a manner that they sequentially pass through the plane extending through the carrier axes in intermeshing relationship when the carriers are counterrotated. That is to say, when all the mixer blades on a first carrier which extend in the same radial direction pass the second carrier, the blades on the second carrier located in the same respective lateral planes as the passing blades on the first carrier are disposed at a different radial angle so that the blades of the two carriers which are located in the same plane do not interfere with each other during operation of the mixer. The blades are constructed with straight line tips that extend parallel with the chamber inner walls. The pitch of the blades, that is, the distance between the centers of the blades, is just slightly greater than the width of each blade along the carrier axis, whereby there is only slight longitudinal distance between the blades along each carrier. This assures that virtually every area of the surface of the mixing chamber and its entire internal volume is swept by a mixer blade during each revolution of the carrier. The blades may be formed from cylindrical elements provided with wedge-shaped tip areas, with the body of each blade having a diameter as great as the tip width. Finally, the free lengths of the blades, the diameters of the carriers, and the distance between the axes of the carriers, are all arranged such that the tips of the blades pass close to the peripheral surface of the carriers. Thus, the entire volume of a composition within the mixing chambers is agitated and kneaded by the blades as it passes along the length of the chambers.

For heating or cooling the composition within the chambers, a hollow jacket can be provided spaced from the external walls of the mixing chambers and through which a heating or cooling medium can be circulated in a desired flow pattern. The intimate mixing of the composition within the mixing chambers by the mixer blades enables a thorough heat exchange relationship to exist between the composition within the chambers and the heat exchange medium.

The invention has particular application in connection with in-line mixing of additives into a stream of synthetic resin composition immediately before extrusion of the resin. A typical resin, for example, could be polystyrene and a typical additive could be mineral oil. A separate pump outside the mixer is used to create a pressure differential between the inlet and outlet ends of the mixing chambers so that the mixer blades themselves do not have to move the material through the mixer.

It has been found in tests that an additive such as mineral oil could be added to a polystyrene resin immediately before extrusion of the resin through a multi-apertured die head with good results. The invention has application for other additives and, of course, can be used in any environment where complete mixing is required with or without heat exchange.

DETAILED DESCRIPTION OF PREFERRED EMBODIMENT

Figure 1:
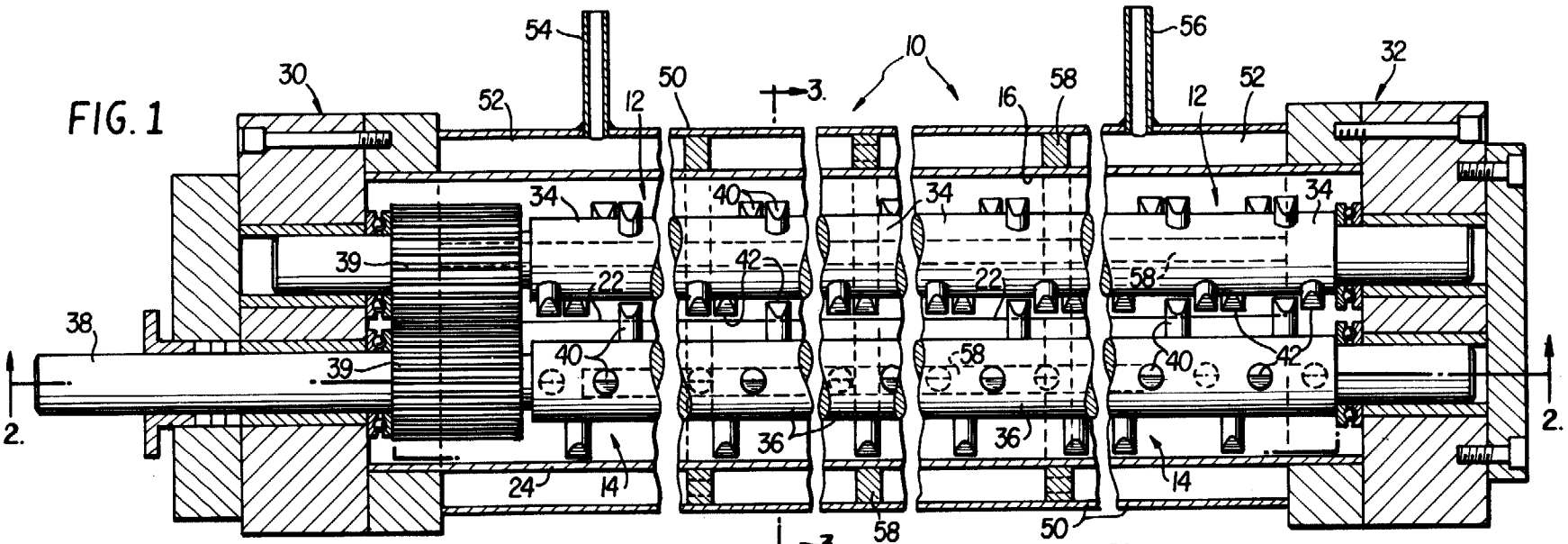
FIG. 1 is a longitudinal sectional plan view of a mixer constructed in accordance with this invention.
Figure 2:
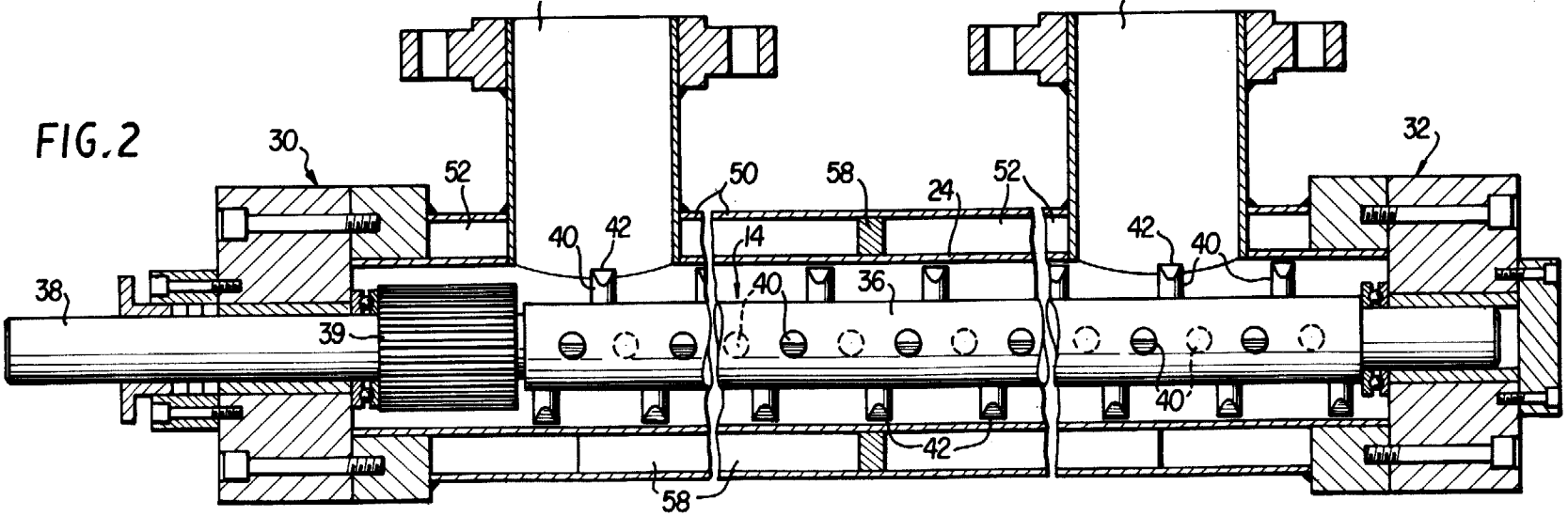
FIG. 2 is a sectional view taken along lines 2—2 of FIG. 1.

With reference to FIG. 1, a mixer and heat exchanger constructed in accordance with the present invention is generally illustrated at 10 and comprises a pair of elongated parallel mixing chambers 12, 14 having cylindrical inner walls 16, 18, respectively, the walls having equal diameters D and being innerconnected along a common open channel 20 that lies in an imaginary plane extending through the intersections between the circumferences of the inner walls 16, 18 of the chambers 12, 14. The channel 20, therefore, has sharp edges 22 extending along the intersections of the circumferences of the inner walls 16, 18, and corresponds in width to the chordal distance between the intersections of the circumferences.

Figure 3:
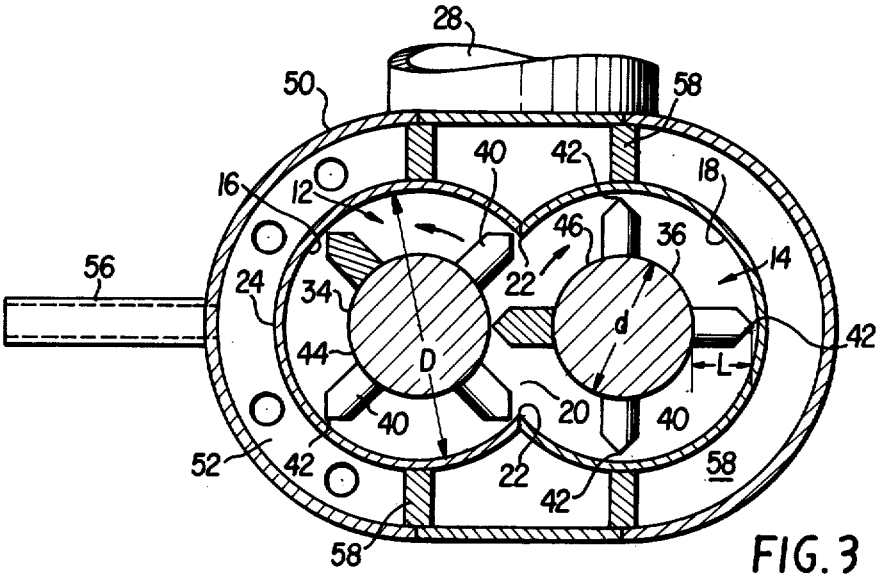
FIG. 3 is a vertical sectional view taken along lines 3—3 of FIG. 1.

The chambers 12, 18 are illustrated within a housing 24 which may have suitable outer curvature, but preferably a contour similar to that shown in the cross sectional view of FIG. 3. An inlet 26 and an outlet 28 are in communication with opposite ends of the chambers 12 and 14 to permit entry and exit of a flowable composition (not shown) normally pumped through the mixer by an external means capable of creating a pressure differential between the inlet and outlet sides of the mixer.

The opposite ends of the housing 24 are supported by end plate assemblies 30, 32 which effectively block the ends of the chambers and provide supports for the bearings of the mixer blade carriers 34, 36 extending respectively concentrically through the chambers 12, 14, respectively.

The carriers 34, 36 are rotatably supported at their opposite ends within end plate assemblies 30, 32, with the carrier 36 having a shaft extension 38 that protrudes beyond end plate 30 to enable it to be connected to a drive means (not illustrated). The carriers 34, 36 are interconnected by means of spur gearing 40 located in chambers 12, 18 which causes the carriers to rotate in opposite directions in a synchronized manner. As illustrated, the spur gears are of equal size and the carriers therefore will rotate at an equal rate of speed in opposite directions. The gears, since they are located in the mixing chambers, are lubricated by the composition being mixed.

Figure 4:
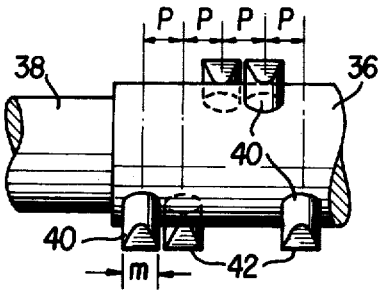
FIG. 4 is a detailed view showing the mixer blades constructed in accordance with the present invention.

The carriers, as shown in FIG. 3, are cylindrical rods having equal diameters d. A plurality of identical mixer blades 40 extend radially from each of the carriers 34, 36 along substantially the entire length of the carriers. Each of the blades, as seen in FIGS. 3 and 4, has a radial free length L, the radial free length being defined as the radial distance between the tip of the blade and the surface of the carrier 34, 36, and a tip width m that extends parallel to the axis of each respective chamber 12, 14 in which the blade lies. The blades shown are cylindrical and have wedge-shaped tips converging to substantially thin, straight lines. The axial pitch p between the centers of the blade tips (and the blades themselves in the illustrated embodiment) is just slightly greater than the blade tip width m, so that only a small clearance exists between the sweep of each blade tip about the inner wall of the chambers. Thus, when the carriers are rotated, virtually every linear increment of the chambers is scraped by the tips of the blades 40. Since the width of each blade along its respective carrier likewise is the same as the tips, the entire volume with the mixer is swept by the blades each revolution of the carriers. The distance between the axes of the chambers 12, 14 (and likewise of the axes of the carriers 34, 36) is slightly greater than D minus L, so that when the blades pass the opposite carrier, they pass with only a small clearance. This dimensional arrangement further provides assurance that all of the volume within the mixing chambers is swept by the blades, and in particular, the central area between the carriers.

The blades 40 on each respective carrier are sequentially and progressively offset 90 degrees from each adjacent blade in a helical manner about the periphery of the carrier along its length. Moreover, the blades 40 on each carrier lie directly opposite each other in the same transverse plane but are circumferentially oriented in a manner such that they intermesh with each other when the carriers are counterrotated. In the illustrated embodiment, as shown in FIG. 3, the blades on each carrier are located circumferentially 90 degrees away from each other progressively along the carrier, but each blade on one carrier leads the blade lying in the same transverse (radial) plane on the other carrier in a rotational sense so the blades in the same plane never occupy the same space between the carriers at the same time.

It will be apparent from looking at FIG. 3 that the assembly of the carriers 34, 36, their respective blades, and the inner walls of the chambers 16, 18 have a dimensional relationship substantially in accordance with the formula $D=d+2L$. That is to say, only a very slight running clearance is provided between the blade tips 42 and the inner walls 16, 18 of the chambers. Likewise, only a very small clearance is desired between the outer peripheral surface 44, 46 of each carrier 34, 36 and the tips 42 of the blades on the opposite carrier. Due to this interrelationship of the elements, and the geometry of the common channel 20, a flowable composition within the chambers 12, 14 is intimately kneaded together and mixed with virtually no area occupied by the composition within the length of the chambers not being swept by a mixer blade during each revolution of the carriers.

Under circumstances where the flowable composition is a polymer material to which an additive has been introduced upstream of the mixing chambers, a complete and intimate mixing together of the ingredients will be assured over the length of the mixing chambers. In particular, the nature of the central channel 20 with its sharp edges 22 that are closely swept by both sets of blades 40 assures that there are no "dead" spots in this area of the mixing chamber through which the flowable composition could move without being thoroughly blended into the remainder of the mass of material moving through the mixer.

The mixer 10 could have application in a heat exchanger environment wherein a flowable composition moving through the mixing chambers is caused to flow in heat exchange relationship with a heat exchange medium circulated externally of the housing 24. To this end, a second enclosing housing 50 spaced from housing 24 is provided, with the hollow space 52 being provided for enabling circulation of a heat exchange medium entirely about the mixing chambers. The heat exchange medium could be a heated fluid or a heat absorbing medium, depending upon the desired application. Where it is desired to heat the composition flowing through the heat exchange chambers, a suitable heat exchange medium could be hot oil circulated in space 52 between inlet 54 and outlet 56. If it is desired, on the other hand, to cool the material flowing through the mixing chambers, a suitable heat absorbing medium such as cold water or brine could be circulated through the space 52.

Figure 5:
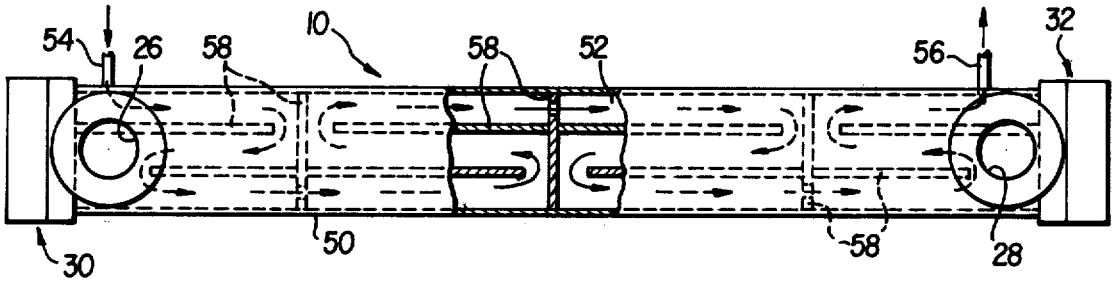
FIG. 5 is a schematic illustration of the flow pattern of heat exchange medium through the mixer.

To promote orderly circulation of heat exchange medium along the mixing chambers within the space 52, a suitable arrangement of baffles 58 is provided within the hollow space 52. Some of the baffles are horizontal and some are vertical in order to obtain a flow pattern of heat exchange medium similar to that illustrated in FIG. 5. The circulation arrangement illustrated in FIG. 5 is particularly effective in distributing the heat exchange medium properly along the length of the mixing chambers.

It will be apparent that various modifications of the embodiment illustrated could be made by those skilled in the art without departing from the spirit and scope of the invention, and it should be apparent that other embodiments of the invention could be constructed. The invention is not to be limited, however, except by the claims appended hereto.

What is claimed is:

1. A mixer for thoroughly mixing, without any dead space, a flowable composition comprising (a) first and second parallel, adjacent mixing chambers having cylindrical inner walls each having a diameter D, said cylindrical walls intersecting along the entire length of the mixing chambers to define a common open channel between the chambers, said open channel lying in a plane extending through the intersections between the circumferences of the inner walls of the chambers and corresponding in width substantially to the chordal distance between said intersections;

first and second rotatable carriers extending axially concentrically through said first and second chambers, respectively, the carriers being supported for synchronized rotation about their axes in opposite directions;

(c) a plurality of blades each having a radial free length L mounted upon and extending radially from each carrier along substantially the entire length of each carrier, the blades on each carrier being sequentially and progressively offset circumferentially from each adjacent blade about the periphery of the carrier and each carrier having a maximum diametrical dimension d where it joins the free length of each blade;

(d) each blade on said first carrier lying in the same radial plane as one blade on said second carrier to form a plurality of blade pairs, the blade pairs intermeshing with each other between the carriers when the carriers are oppositely rotated, each blade having a width m extending along the axis of the chamber;

(e) the distance between the axes of the chambers being slightly greater than D minus L, and each assembly of a carrier, its respective blades, and the inner wall of its respective chamber having a dimensional relationship substantially in accordance with the formula: $D=d+2L$, whereby said blades, when in rotation, pass in close proximity to said cylindrical inner walls except when passing through said common open channel, and when passing through said open channel, pass in close proximity to the other carrier; and (f) inlet and outlet means at opposite ends of the chambers for a composition to be mixed.

2. A mixer according to claim 1, wherein adjacent blades on each carrier are circumferentially spaced 90° apart.

3. A mixer according to claim 1, wherein said blades comprise cylindrical members of a diameter m with wedge-shaped tips having a width m.

4. A mixer according to claim 3, wherein the spacing between the center axes of said cylindrical members is only slightly greater than m.

5. A mixer according to claim 1, wherein each carrier comprise a cylindrical rod; said blades are fixed to the periphery of the rod; and the blades have wedge-shaped tips.

6. A mixer according to claim 1, including an outer enclosure for said chambers defining a hollow space substantially surrounding the chambers, and means for enabling circulation of a heat exchange medium within the hollow space.

7. A mixer according to claim 6, including vertical and horizontal flow dividing baffles in the hollow space for directing flow of heat exchange medium along the chambers in a predetermined pattern.

8. A mixer according to claim 1, wherein said carriers are coupled together by spur gearing connected to at least one end of the carriers, the spur gearing being disposed within the mixing chambers to thereby enable their lubrication by the flowable composition.

* * * * *